United States Patent [19]

Dronnesund et al.

[11] Patent Number: 4,956,054

[45] Date of Patent: Sep. 11, 1990

[54] METHOD AND APPARATUS FOR REMOVING CARBON ANODES IN ALUMINUM ELECTROLYSIS CELLS

[75] Inventors: Kjartan Dronnesund, Ardalstangen; Heggo Stale, Ovre Ardal, both of Norway

[73] Assignee: Norsk Hydro a.s., Oslo, Norway

[21] Appl. No.: 295,791

[22] Filed: Jan. 11, 1989

[30] Foreign Application Priority Data

Jan. 12, 1988 [NO] Norway ..... 880100

[51] Int. Cl.[5] ..... C25C 3/06; C25C 3/14

[52] U.S. Cl. ..... 204/67; 204/245

[58] Field of Search ..... 204/243 R, 244–247, 204/67; 30/379, 379.5; 83/928

[56] References Cited

U.S. PATENT DOCUMENTS

| | | | |
|---|---|---|---|
| 3,306,668 | 2/1967 | Ellingsaeter et al. | 299/70 |
| 4,019,973 | 4/1977 | Natvik et al. | 204/243 R X |
| 4,778,304 | 10/1988 | Baldi et al. | 30/379 X |
| 4,832,412 | 5/1989 | Bertrand | 30/379 X |

FOREIGN PATENT DOCUMENTS

| | | | |
|---|---|---|---|
| 1032895 | 6/1978 | Canada | 204/243 R |
| 992830 | 5/1965 | United Kingdom | 204/243 R |
| 1017163 | 1/1966 | United Kingdom | 204/243 R |

*Primary Examiner*—Donald R. Valentine

*Attorney, Agent, or Firm*—Wenderoth, Lind & Ponack

[57] ABSTRACT

Method used in connection with the exchange of anodes in cells producing aluminum by electrolysis according to the Hall-Heroult process. Each cell comprises a cathode containing a fused salt bath or aluminum oxide dissolved in cryolite, and above the cathode is provided one or more carbon anodes which are partly submerged in the bath and are partly covered with and surrounded by a crust which forms on the bath. Immediately before a used anode is to be removed a cut is made in the crust all the way around the anode and as close to the anode as possible. A device for performing the method is in the form of a crust cutter comprising a share which is turnably mounted around a vertical axis on the outer end of a telescopic device. The telescopic device at its inner end is mounted for rotation about its longitudinal axis in a housing or frame construction which can be raised or lowered.

20 Claims, 4 Drawing Sheets

METHOD AND APPARATUS FOR REMOVING CARBON ANODES IN ALUMINUM ELECTROLYSIS CELLS

BACKGROUND OF THE INVENTION

The present invention relates to a method used in connection with the exchange of anodes in cells producing aluminum by electrolysis according to the Hall-Heroult process.

DESCRIPTION OF THE PRIOR ART

Industrial production of aluminum is accomplished by electrolysis of aluminum oxide dissolved in melted cryolite, into which is added small amounts of additives, mainly aluminum fluoride and calcium fluoride, at temperatures from 950°-970° C. With the so-called Hall-Heroult process, named after the inventors, aluminum is produced in a liquid state and deposited on the cathode such that the aluminum represents the actual cathode. Carbon anodes, made of petrol coke and pitch, are partly submerged in the electrolyte which is usually called the melt bath. On the bottom side of the prebaked anodes the aluminum oxide is decomposed under the creation of oxygen which promptly reacts with the carbon of the anode to carbon dioxide.

Usually there an about 20 prebaked anodes in an electrolysis cell, and since the anodes are gradually consumed, each anode has to be exchanged after 20-24 days. Each cell therefore has one anode exchanged every day.

The melt bath is covered with a crust composed of solidified cryolite melt and an aluminum oxide layer. Since the anodes are partly submerged in the melt, the crust partly cover and fixedly holds the anodes. When the anodes are completely used, they may well be fully covered with crust. Thus, when the anodes are exchanged they have to be "released" from the crust before being removed. This is for the most part done by breaking up the crust around the anodes. To some extent the anodes are simply pulled out, without having released them from the crust. In both cases, however, parts of the crust, incidently also part of the anodes, will fall down to the bottom of the cells. These crust parts or pieces will, if they are not removed, cause problems and disturbances during the electrolysis process. Removing the crust pieces adds more work for the operational personnel which again results in higher operational costs. Besides, there is a certain probability that all of the pieces are not removed, and this again will cause operational disturbances.

OBJECT OF THE INVENTION

It is a main object of the present invention to provide a method and an arrangement for use in connection with the exchange of carbon anodes in cells producing aluminum by electrolysis which is not encumbered with the above disadvantages.

BRIEF DESCRIPTION OF THE DRAWINGS

The invention will now be further described by means of example and with reference to the drawings in which.

DETAILED DESCRIPTION OF THE INVENTION

As previously mentioned, the anodes have to be exchanged when they have reached their lowermost position. The method according to the present invention is characterized in that there is made a through-going cut in the crust around, and as close as possible to, the anodes before they are pulled out of the cell.

Figure 1:
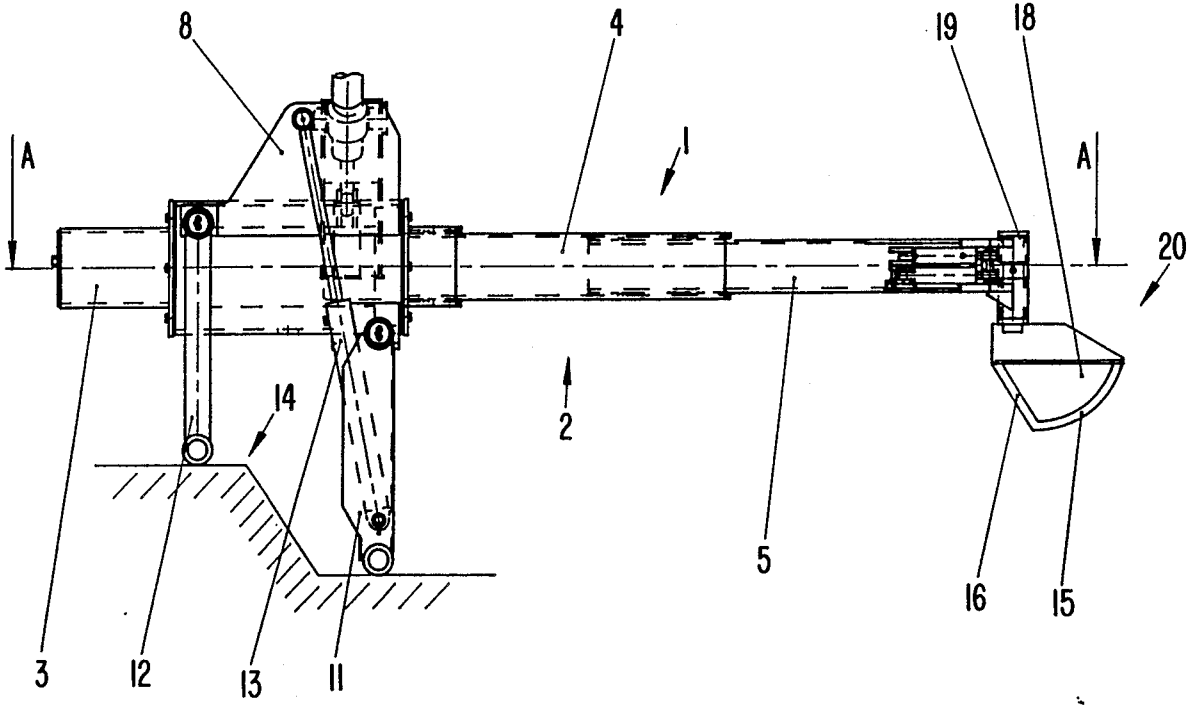
FIG. 1 is a side view of a device for performing the method and which is in the form of crust cutter.
Figure 2:
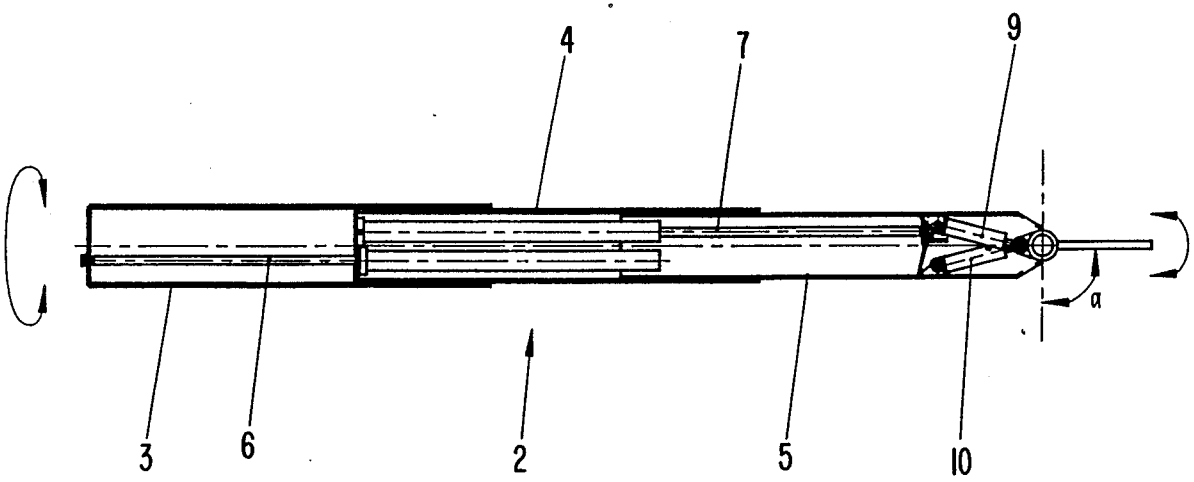
FIG. 2 is a horizontal section of the crust cutter along the line A—A in FIG. 1, FIGS. 3*a* and *b* are front and side vies, respectively, of an alternative cutter shape.

In FIGS. 1 and 2 is shown a device for performing the method and which is in the form of crust cutter 1. As can be seen from the drawings, the crust cutter comprises a share 20 which is turnably mounted on the outer end of telescopic arm 2 by means of cylinder/piston arrangement 9,10. The telescopic device comprises an inner part 3, an intermediate part 4 and an outer part 5. The intermediate and outer parts can be moved in their longitudinal direction by means of a piston/cylinder arrangements 6 and 7, respectively. Further, the telescopic arm can be rotated relative to its longitudinal axis in a housing or frame construction 8, and the housing itself can be raised or lowered by means of parallel arms 11 and 12, and a cylinder/piston arrangement 13. Thus, the crust cutter may be raised or lowered and can be mounted on a vehicle 14 as shown in FIG. 4, or it can be mounted on a crane or the like (not shown).

Figure 3A:
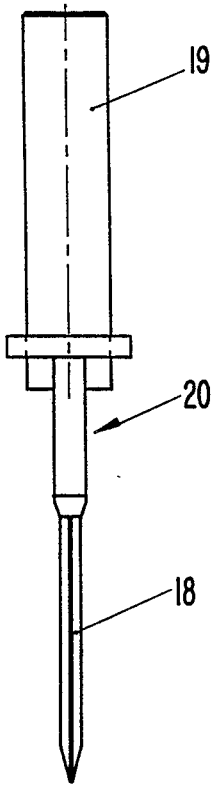
Figure 3B:
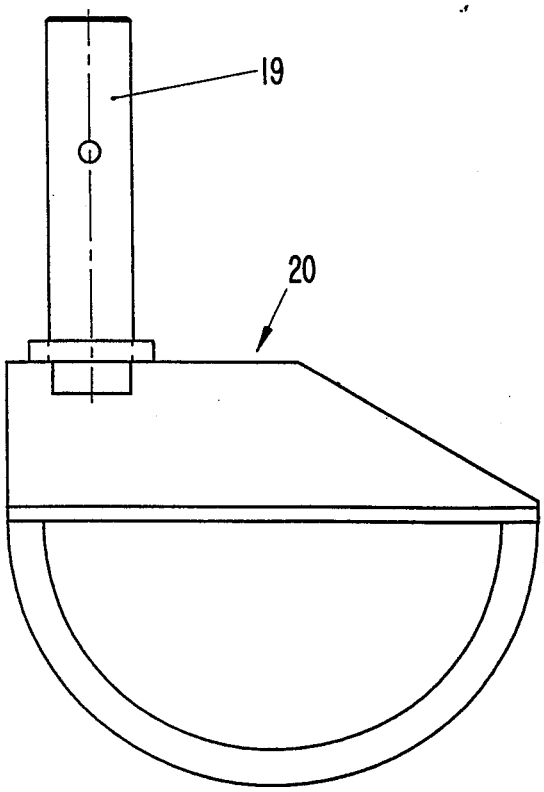

The cutter share 20 consists of a steel plate 18 which is provided with a partly circular cutting edge 15 and a declining cutting edge 16. Alternatively, the cutter can be designed as shown in FIG. 3, where the cutting edge 17 is semi circular. The steel plate 18 is connected to a pivot 19, and is through this pivot turnable in both side directions through an angle $\alpha$ of at least 90°. The turning motion of the cutter can, as previously mentioned, be obtained by means of a cylinder/pistol arrangement 9,10. Other arrangements for turning of the cutter may also be used, such as a motor/toothed wheel transmition.

Figure 4:
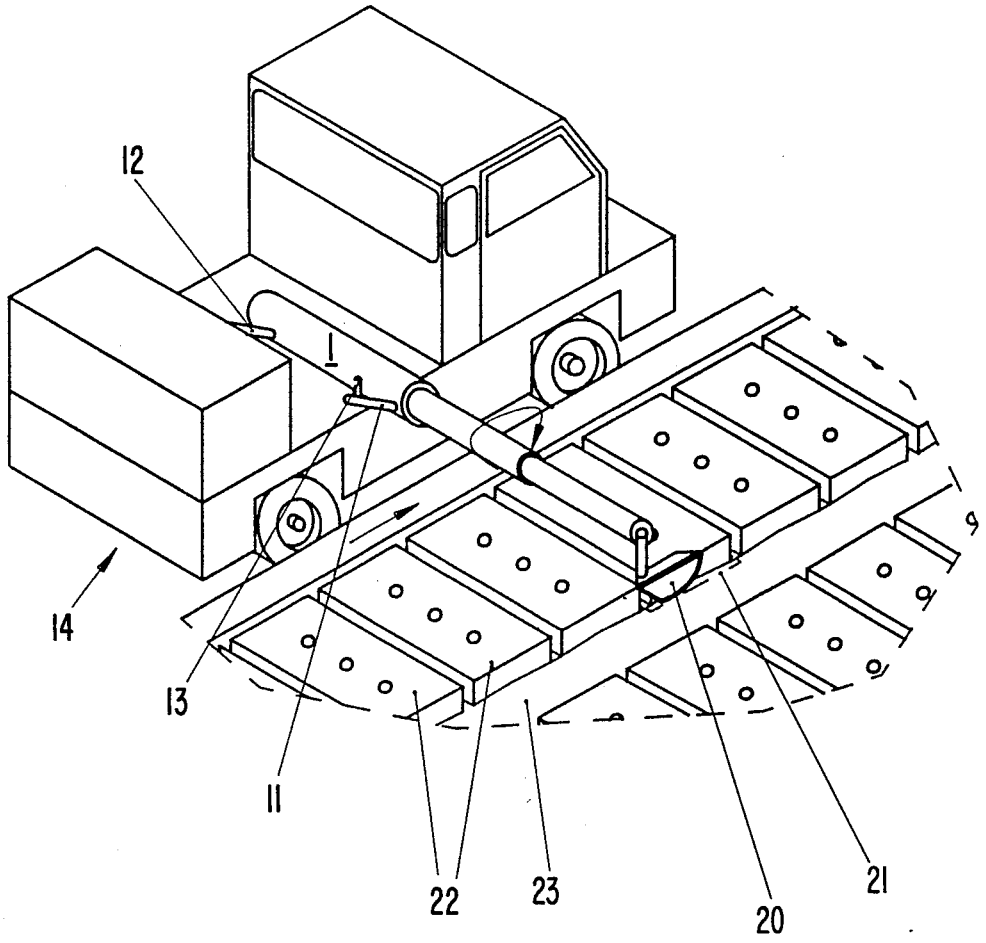
FIG. 4 is a perspective view of a crust cutter mounted on a vehicle which is placed along side an electrolysis cell.

FIG. 4 shows a crust cutter according to the invention mounted on a vehicle 14. The vehicle is placed alongside an electrolysis cell. Only a part of the cell is shown, and for practical reasons and to be able to see the cutter in operation, the anode bar, the current connections, the anode super structure etc. is not indicated in the drawing.

The cutting of the crust along the sides of the anodes is accomplished by firstly forcing the share 20 (the edge 15,16, 17) through the crust, and thereafter by pulling the telescopic device in, or by pushing it out. At the short ends of the anodes the crust is, however, cut in the following way: The telescopic device is extracted to a position where the share 20 is at the outer or inner end of the anode being exchanged. Thereafter the share is turned to an angle of 90° relative to the longitudinal axis of the telescopic device. This position is shown in FIG. 4. The cutting is now accomplished by turning the telescopic device to the right, or by lowering the telescopic device so that the cutting edge is forced through the crust. Since the length of the share is shorter than the length of the ends of the anodes, a corresponding cutting operation has to be performed from the other side of the anode.

After having cut the crust all the way around the anode, the anode can now be extracted and be exchanged with a new one.

By means of the here described method it has been possible to avoid that crust pieces falling into the bottom of the cell. This again implies that the following cleaning of the cell bottom, operational disturbances and problems caused by the remaining crust pieces on the cell bottom, is avoided.

We claim:

1. An apparatus for cutting crust in an aluminum production electrolysis cell, comprising:

a movable base;

an elongated arm connected to said base near a first end of said arm and having a longitudinal axis extending essentially horizontally, whereby the arm may be extended over the cell;

means connected to said arm for raising and lowering said arm with respect to said base within a substantially vertical plane;

a fixed share mounted at a free second end of said arm for rotation with respect to said arm about a substantially vertical axis, said fixed share being adapted to cut the crust on the cell; and means for rotating said share with respect to said arm about said vertical axis.

2. An apparatus as in claim 1, wherein said share includes a cutting edge extending along a semi-circular periphery.

3. An apparatus as in claim 1, wherein said share includes a cutting edge extending along a periphery having a semi-circular portion and an inclined portion.

4. An apparatus as in claim 1, wherein said arm is rotatable with respect to said base about said longitudinal axis, and further comprising means for rotating said arm about said longitudinal axis.

5. An apparatus as in claim 4, wherein said share includes a cutting edge extending along a semi-circular periphery.

6. An apparatus as in claim 4, wherein said share includes a cutting edge extending along a periphery having a semi-circular portion and an inclined portion.

7. An apparatus as in claim 4, wherein said movable base is a vehicle.

8. An apparatus as in claim 4, wherein said movable base is a crane.

9. An apparatus as in claim 1, wherein said arm is extensible and contractable along said longitudinal axis, and further comprising means for extending and contracting said arm.

10. An apparatus as in claim 9, wherein said arm is rotatable with respect to said base about said longitudinal axis, and further comprising means for rotating said arm about said longitudinal axis.

11. An apparatus as in claim 10, wherein said means for raising and lowering said arm comprises linkage means for raising and lowering said arm while maintaining said longitudinal axis of said arm essentially horizontal.

12. An apparatus as in claim 11, wherein said share includes a cutting edge extending along a semi-circular periphery.

13. An apparatus as in claim 11, wherein said share includes a cutting edge extending along a periphery having a semi-circular portion and an inclined portion.

14. An apparatus as in claim 11, wherein said movable base is a vehicle.

15. An apparatus as in claim 11, wherein said movable base is a crane means.

16. A method for cutting crust about an anode in an aluminum production electrolysis cell, comprising the steps of:

(A) providing a movable base, an elongated arm connected to said base near a first end of said arm and having a longitudinal axis extending essentially horizontally, said arm being extensible and contractable along said longitudinal axis, means connected to said arm for raising and lowering said arm with respect to said base within a substantially vertical plane, a fixed share mounted at a free second end of said arm for rotation with respect to said arm about a substantially vertical axis, and means for rotating said share with respect to said arm about said vertical axis;

(B) moving said base to place said arm near a first longitudinal side of the anode;

(C) rotating said share about said vertical axis until said cutting edge extends substantially perpendicular to said longitudinal axis, and extending said arm until said cutting edge is near a transverse side of the anode;

(D) lowering said share until at least a portion of said cutting edge extends through the crust, whereby a transverse cut is formed, and thereafter raising said share until said cutting edge is above said crust;

(E) rotating said share about said vertical axis until said cutting edge extends substantially parallel to said longitudinal axis;

(F) lowering said arm until at least a portion of said cutting edge extends through the crust;

(G) extending or retracting said arm as required to move said share from the current transverse side of the anode to the other transverse side of the anode, whereby a longitudinal cut is formed, and thereafter raising said arm until said cutting edge is above said crust;

(H) rotating said share about said vertical axis until said cutting edge is substantially perpendicular to said longitudinal axis;

(I) repeating step (D);

(J) moving said base means to place said arm near a second longitudinal side of the anode; and (K) repearing steps (E)–(G).

17. A method as in claim 16, wherein in step (D) said step of lowering said share comprises lowering said arm.

18. A method as in claim 17, further comprising, subsequent to step (I) and prior to step (J), retracting said arm, and also further comprising, subsequent to step (J) and prior to step (K), extending said arm until said cutting edge is near one of the transverse sides of the anode.

19. A method as in claim 16, wherein in step (A) said step of providing an arm further comprises said arm being rotatable with respect to said base about said longitudinal axis, step (A) further comprises providing means for rotating said arm about said longitudinal axis, and in step (D) said step of lowering and raising said share comprises oscillating said arm about said longitudinal axis.

20. A method as in claim 19, further comprising, subsequent to step (I) and prior to step (J), retracting said arm, and also further comprising, subsequent to step (J) and prior to step (K), extending said arm until said cutting edge is near one of the transverse sides of the anode.

* * * * *